US009441827B2

(12) United States Patent
Hagenstad

(10) Patent No.: US 9,441,827 B2
(45) Date of Patent: Sep. 13, 2016

(54) ILLUMINATED PROTECTION DISK

(71) Applicant: Eric Hagenstad, Santa Rosa, CA (US)

(72) Inventor: Eric Hagenstad, Santa Rosa, CA (US)

( * ) Notice: Subject to any disclaimer, the term of this patent is extended or adjusted under 35 U.S.C. 154(b) by 63 days.

(21) Appl. No.: 14/562,979

(22) Filed: Dec. 8, 2014

(65) Prior Publication Data

US 2016/0161104 A1 Jun. 9, 2016

(51) Int. Cl.

| | |
|---|---|
| ***F21V 15/04*** | (2006.01) |
| ***F21V 23/00*** | (2015.01) |
| ***F21V 7/00*** | (2006.01) |
| ***F21V 33/00*** | (2006.01) |
| ***F21V 23/02*** | (2006.01) |
| *F21Y 101/02* | (2006.01) |
| *F21Y 113/00* | (2016.01) |

(52) U.S. Cl.

CPC ..... *F21V 33/00* (2013.01); *F21V 7/0066* (2013.01); *F21V 15/04* (2013.01); *F21V 23/009* (2013.01); *F21V 23/023* (2013.01); *F21V 33/0024* (2013.01); *F21Y 2101/02* (2013.01); *F21Y 2113/005* (2013.01)

(58) Field of Classification Search

CPC ..... F21V 33/00; F21V 33/0004; F21V 33/0024; F21V 7/0066; F21V 23/009; F21V 23/023; F21V 15/04; F21Y 2113/005

USPC ..... 362/101

See application file for complete search history.

(56) References Cited

U.S. PATENT DOCUMENTS

| | | | | |
|---|---|---|---|---|
| 5,307,250 | A * | 4/1994 | Pearson | A47G 23/0309 200/85 R |
| 6,092,905 | A * | 7/2000 | Koehn | A47G 23/0216 362/101 |
| 6,305,817 | B1 * | 10/2001 | Johnston | A47G 23/0216 362/101 |
| 6,419,384 | B1 * | 7/2002 | Lewis | A01K 7/00 200/61.45 R |
| 6,793,363 | B2 * | 9/2004 | Jensen | A47G 23/0309 362/101 |
| 6,863,415 | B2 * | 3/2005 | Lu | A47G 23/0309 362/101 |
| 7,168,820 | B1 * | 1/2007 | Minassian | A47G 7/06 362/101 |
| 8,186,853 | B2 * | 5/2012 | Popovsky | C11D 3/0094 362/101 |
| 2004/0125594 | A1 * | 7/2004 | Wu | A47G 23/0309 362/101 |

* cited by examiner

*Primary Examiner* — Alan Cariaso

(74) *Attorney, Agent, or Firm* — Gulf Coast Intellectual Property Group

(57) ABSTRACT

A protective disk that is operable to be releasably secured to a glass vessel wherein the protective disk is configured to provide illumination projected into the glass vessel. The protective disk further includes a body that is annular in shape. The body includes a first layer and second layer contiguously formed. The second layer of the body has a light assembly disposed therein and is manufactured from a translucent impact absorbing material. The protective disk further includes an adhesive layer disposed on the first layer of the body opposite the second layer that functions to releasably secure the protective disk to a glass vessel. A power supply and controller are further included to provide power and control the operation of the protective disk. Additionally included is a reflective surface disposed on the second layer adjacent the first layer.

13 Claims, 1 Drawing Sheet

ILLUMINATED PROTECTION DISK

FIELD OF THE INVENTION

The present invention relates generally to protective apparatus, more specifically but not by way of limitation, a protective disk for a fragile vessel such as but not limited to a glass vessel, wherein the protective disk is further configured to illuminate.

BACKGROUND

Vessels are utilized by millions of individuals for various applications. Whether it is in a laboratory environment or for a domestic application, vessels are routinely employed to assist in the accomplishment of a desired task. By way of example, vessels are typically used in the storage of liquids. Conventional vessels can be manufactured from numerous types of materials such as but not limited to glass.

Glass vessels are manufactured in numerous alternative types for various applications. From conventional glasses to laboratory flasks, glass and glass-like materials are used as the material is non-reactive and provides a good environment to dispose a material therein. One type of glass vessel that has rapidly expanded in use is the water pipe. Water pipes have become more common with the expansion of the legalization of marijuana and they are additionally used as a delivery mechanism for specialty tobaccos.

One issue with current water pipes and similar apparatus is their fragility. With glass being the preferred material, they can often break during use if users do not exercise a certain degree of caution. As theses types of vessels currently do not employ any type of protective bottom layer, they are vulnerable to breakage. Additionally, it is cosmetically desirable to provide a protective apparatus for these types of vessels wherein the protective apparatus further provides a cosmetic enhancement such as but not limited to illumination.

SUMMARY OF THE INVENTION

It is the object of the present invention to provide a protective apparatus for a vessel that is releasably secured to the bottom of the vessel so as to provide a layer of protection intermediate the vessel and its support surface.

Another object of the present invention is to provide a protective apparatus for a glass vessel or similar item that is annular in shape and includes a first layer and a second layer.

A further object of the present invention is to provide a protective apparatus for a glass vessel such as but not limited to a water pipe wherein the first layer of the protective apparatus is non-translucent.

An additional object of the present invention is to provide a protective apparatus for a glass vessel that is operable to be releasably secured to the bottom of a glass vessel wherein the second layer of the protective apparatus is translucent.

Still another object of the present invention is to provide a protective apparatus for a glass vessel that further includes a layer of pressure sensitive adhesive on the outer surface of the second layer.

Yet a further object of the present invention is to provide a protective apparatus for a glass vessel that is operable to be releasably secured to the bottom thereof that further includes a light source embedded into the second layer thereof.

An alternative object of the present invention is to provide a protective apparatus for a glass vessel configured to be releasably secured to the bottom thereof wherein the protective apparatus includes a power supply disposed in the first layer thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
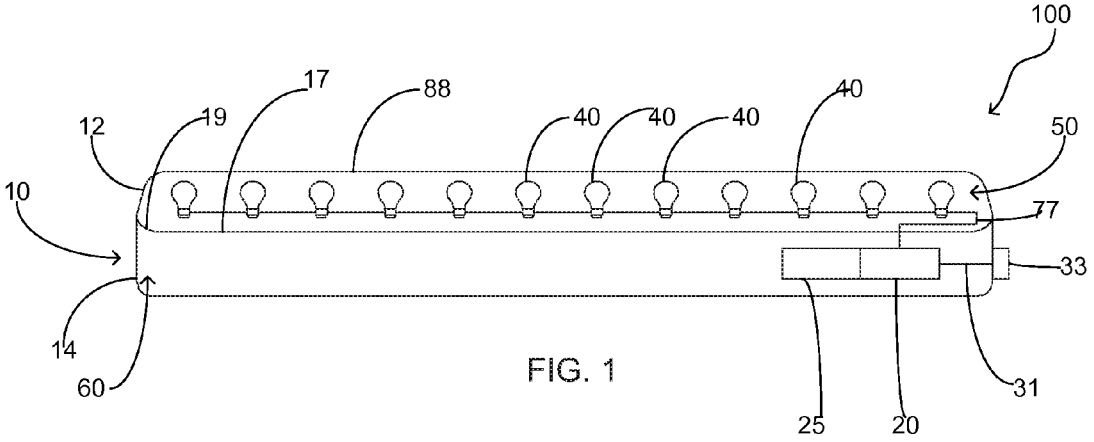
FIG. 1 is a cross-sectional view of a preferred embodiment of the present invention.
Figure 2:
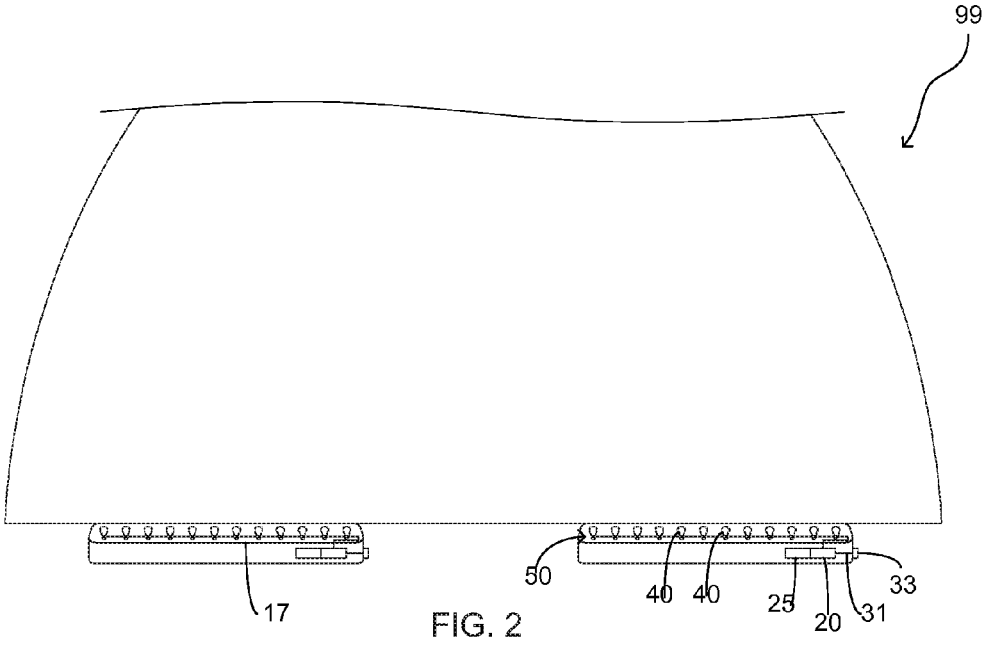
FIG. 2 is a cross-sectional diagram of the present invention secured to the bottom of an exemplary vessel.

Referring now to the drawings submitted herewith, wherein various elements depicted therein are not necessarily drawn to scale and wherein through the views and figures like elements are referenced with identical reference numerals, there is illustrated an illuminated protective disk 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein the illuminated protective disk 100 further includes a body 10. The body 10 includes an integrally formed first layer 14 and second layer 12 and is manufactured from an impact absorbing material such as but not limited to silicone or other rubber. The first layer 14 and second layer 12 are integrally formed utilizing suitable durable techniques. The body 10 is operable to provide a protective structure so as to inhibit damage to the exemplary vessel 99. While no particular shape of the body 10 is required, it is contemplated within the scope of the present invention that the preferred embodiment of the illuminated protective disk 100 has a body 10 that is annular in shape. Furthermore, it is contemplated within the scope of the present invention that the body 10 is approximately one-quarter inch in thickness. Good results have been achieved utilizing a height of approximately one-quarter inch in thickness in order to provide sufficient protection of the exemplary vessel 99. Those skilled in the art will recognize that the body 10 could be manufactured having various different thicknesses in order to accomplish the desired objective herein.

The first layer 14 in its preferred embodiment is manufactured from a non-translucent material. Disposed within the first layer 14 are a power supply 20 and controller 25. The power supply 20 is operable to provide the necessary power to the controller 25 and lights 40. While no particular power supply 20 is required, good results have been achieved utilizing a lithium ion battery for a power supply 20. Adjacent to the power supply 20 and operably coupled thereto is a controller 25. The controller 25 includes the necessary electronics to store, receive, transmit and manipulate data. The controller 25 is operable to provide operation of the light assembly 50. It is contemplated within the scope of the present invention that the controller 25 functions to operate the illuminated protective disk 100 in a first mode and a second mode. In its first mode, the light assembly 50 of the illuminated protective disk 100 is illuminated continuously. In the second mode the light assembly 50 of the illuminated protective disk 100 is illuminated in a random pattern such as but not limited to blinking so as to provide an alternative visual effect. The power supply 20 is operated by switch 33, which is operably coupled to power supply via wire 31. Switch 33 is a conventional push button style switch and functions to turn the light assembly 50 on or off.

The first layer 14 is manufactured from a non-translucent material so as to conceal the power supply 20 and controller 25. The first layer 14 further includes an upper surface 17. The upper surface 17 has disposed thereon substantially across its entirety a reflective material. The reflective material is operable to direct light waves emitted from the lights 40 in an upwards direction so as to improve the visual effect. It is contemplated within the scope of the present invention that numerous types of substances could be utilized for the reflective material such as but not limited to metal. Proximate the outer edge 60 of the first layer 14 the upper surface 17 includes a curved portion 19. The curved portion 19 extends completely around the outer edge 60 and functions to further direct light waves emitted from the light assembly 50 towards the exemplary vessel 99 in order to enhance the desired visual effect. It is desirable that the exemplary vessel 99 be a glass vessel containing a liquid therein wherein the light waves emitted by the light assembly 50 are directed towards and subsequently diffracted by the liquid thereby creating a unique visual effect.

The light assembly 50 includes a plurality of lights 40 operable to emit light waves in a multitude of wavelengths. While no particular light source is required for the lights 40, good results have been achieved by utilizing RGB light emitting diodes for the lights 40. The light assembly 50 is disposed within the second layer 12, which as stated herein is manufactured from a translucent material so as to promote the desired visual effect. The light assembly is operably coupled to the power supply 20 via wire 77. It is contemplated within the scope of the present invention that the light assembly 50 could include only one light 40 or include a plurality of lights 40 as is illustrated in the drawings submitted herewith. The second layer 12 is secured to the first layer 14 utilizing suitable durable techniques. The second layer 12 includes upper surface 88 that has disposed substantially thereon a pressure sensitive adhesive. The pressure sensitive adhesive is operable to releasably secure the illuminated protective disk 100 to an exemplary glass vessel 99. It is contemplated within the scope of the present invention that numerous types of adhesives could be utilized in order to releasably secure the illuminated protective disk 100 to an exemplary vessel 99. It is further contemplated within the scope of the present invention that the illuminated protective disk 100 is manufactured in a plurality of sizes to allow a user to secure multiple illuminated protective disks 100 to an exemplary vessel.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A protection device that is operable to be secured to the bottom of a vessel wherein the protection device is intermediate the vessel and a support surface on which the vessel is superposed comprising:

a body, said body being manufactured from an impact absorbing material, said body further including a first layer and a second layer, said first layer and said second layer being contiguously formed, said second layer being adjacent the bottom of the vessel subsequent the protection device being releasably secured thereto;

a light assembly, said light assembly being disposed within said second layer, said light assembly having a plurality of lights, said light assembly operable to provide light waves in a plurality of wavelengths;

a power supply, said power supply disposed within said first layer of said body, said power supply operably coupled to said light assembly, said power supply operable to provide power to said light assembly; and wherein said second layer is adjacent the bottom of the vessel to which the protection device is releasably secured thereto so as to facilitate the transmission of light waves from said light assembly towards the vessel.

2. The protection device as recited in claim 1, and further including a controller, said controller operably coupled to said power supply and said light assembly, said controller having the necessary electronics to store, manipulate, transmit and receive data, said controller operable to control said light assembly in a first mode and a second mode.

3. The protection device as recited in claim 2, and further including an adhesive layer, said adhesive layer disposed on said second layer of said body opposite said first layer, said adhesive layer operable to releasably secure said body to the bottom of a vessel.

4. The protection device as recited in claim 3, wherein said second layer of said body is manufactured from a translucent impact absorbing material.

5. The protection device as recited in claim 4, wherein said first layer of said body is manufactured from a non-translucent impact absorbing material.

6. The protection device as recited in claim 5, wherein in said first mode said light assembly is operable to emit a constant light wave pattern and in said second mode said light assembly is operable to emit a random light wave pattern.

7. The protection device as recited in claim 6, and further including a reflective surface, said reflective surface present on said first layer of said body adjacent to said second layer, said reflective surface operable to reflect light waves emitted from said light assembly towards the vessel.

8. A protective disk operable to be secured to the bottom of a glass vessel so as to inhibit damage to the glass vessel during placement of the glass vessel on a support surface wherein the protective disk is operable to provide illumination comprising:

a body, said body being manufactured from an impact absorbing material, said body further including a first layer and a second layer, said first layer and said second layer being contiguously formed, said first layer being manufactured from a non-translucent material, said first layer having an outer peripheral edge that is curved inwards, said second layer being adjacent the bottom of the glass vessel subsequent the protection device being releasably secured thereto;

a light assembly, said light assembly being disposed within said second layer, said light assembly having a plurality of lights, said light assembly operable to provide light waves in a plurality of wavelengths;

a power supply, said power supply disposed within said first layer of said body, said power supply operably coupled to said light assembly, said power supply operable to provide power to said light assembly;

a controller, said controller operably coupled to said power supply and said light assembly, said controller having the necessary electronics to store, manipulate, transmit and receive data, said controller operable to control said light assembly in a first mode and a second mode; and wherein said second layer is adjacent the bottom of the vessel to which the protection disk is releasably secured thereto so as to facilitate the transmission of light waves from said light assembly towards the glass vessel.

9. The protective disk as recited in claim 8, and further including a reflective surface, said reflective surface present on said first layer of said body adjacent to said second layer, said reflective surface operable to reflect light waves emitted from said light assembly towards the glass vessel.

10. The protective disk as recited in claim 9, and further including an adhesive layer, said adhesive layer disposed on said second layer of said body opposite said first layer, said adhesive layer operable to releasably secure said body to the bottom of a glass vessel.

11. The protective disk as recited in claim 10, wherein the curvature of the outer peripheral edge is operable to direct light wave reflections from said light assembly into the glass vessel.

12. The protective disk as recited in claim 11, wherein in said first mode said light assembly is operable to emit a constant light wave pattern and in said second mode said light assembly is operable to emit a random light wave pattern.

13. The protective disk as recited in claim 12, and further including a power switch, said power switch operably coupled to said controller, said power switch operable to cycle the protective disk intermediate an on and off position.

* * * * *